United States Patent [19]

Kotliar

[11] Patent Number: 4,603,825

[45] Date of Patent: Aug. 5, 1986

[54] TACO HOLDER

[76] Inventor: Howard J. Kotliar, 9-28 Pond View, East Patchogue, N.Y. 11772

[21] Appl. No.: 620,487

[22] Filed: Jun. 14, 1984

[51] Int. Cl.[4] ..... A45D 19/04

[52] U.S. Cl. ..... 248/174; 211/13

[58] Field of Search ..... 248/174; 211/13; D7/21, D7/38, 76; 99/426; 220/23.8

[56] References Cited

U.S. PATENT DOCUMENTS

| | | | |
|---|---|---|---|
| D. 44,595 | 8/1913 | Simmons | D7/21 |
| D. 167,810 | 9/1952 | Roop | D7/72 |
| D. 225,254 | 11/1972 | Meaney | D7/38 X |
| D. 239,762 | 5/1976 | Burden et al. | D7/72 X |
| D. 263,786 | 4/1982 | Kohan | D7/76 X |
| D. 264,352 | 5/1982 | Goutchat | D7/72 X |
| D. 279,160 | 6/1985 | Hunt | D7/72 X |
| 2,711,765 | 6/1955 | Pecoraro | D7/76 X |
| 3,171,347 | 3/1965 | Elrod | D7/72 X |
| 3,690,724 | 9/1972 | Douglas | D7/38 X |
| 4,270,660 | 6/1981 | Putt | 211/13 |

FOREIGN PATENT DOCUMENTS

| | | | |
|---|---|---|---|
| 246394 | 3/1926 | Italy | D7/76 X |

*Primary Examiner*—J. Franklin Foss

*Attorney, Agent, or Firm*—Leonard Belkin

[57] ABSTRACT

A taco holder having an extending flat bottom with side walls, the latter being provided with slots wide enough to accommodate fingers to reach in and pick up the partially eaten taco.

4 Claims, 8 Drawing Figures

TACO HOLDER

BACKGROUND OF THE INVENTION

The present invention relates to a taco holder and more particularly to a taco holder having provision for grasping the taco shell with the fingers with reduced inconvenience and of sufficiently economic construction as to be suitable for disposable use or retention by the customer as a favor.

The taco is a sandwich in which finely cut foods such as lettuce, onions, meats and cheeses are piled into a cooked shell. If the shell is folded to form a V-shape, which is a common type of sandwich becoming quite popular in this country, there is great difficulty in retaining all of the food within the partially eaten sandwich when it is placed on a plate or a tray, and the problem is worsened by the tendency of the sandwich to roll over on its side.

This difficulty has long been recognized, and many efforts have been made to cope with it.

For example, a variety of specially designed holders have been produced to support the taco in its upright position when rested on a tray between bites or sampling. Holders of this type are shown in Design U.S. Pat Nos. 257,932, 259,010, 264,668, and 270,027. Also utility U.S. Pat. No. 4,004,501 discloses a tray for supporting tacos while U.S. Pat. No. 2,741,901 shows a similarly featured frankfurter holder.

All the holder designs referred to above have one principal feature in common. The uneaten or partially eaten taco is held upright when it is placed in the cradle provided for it, and in so doing, reduces substantially the tendency for the small pieces of food to roll or slide out of the taco shell.

However, the preceding taco holders have substantial drawbacks which have limited severely their usage. When the partially eaten taco is in its cradle on the holder, at some point the entire remaining taco will be fully enclosed by the side walls of the cradle so that it becomes messy for the fingers to grasp the sandwich.

Another drawback of the holders shown in the aforementioned patents is that the designs are sufficently complex as to be too expensive either to be disposable or to be given away by the fast food enterprises as favors.

SUMMARY OF THE PRESENT INVENTION

This invention overcomes or reduces the problems noted in connection with previous taco holding devices by providing a taco holder which is capable of holding a partially eaten taco while at the same time permitting the eater's fingers to grasp the taco with a minimum of trouble and inconvenience without spillage of any of the food in the shell. In addition the taco holder made in accordance with the principles of this invention is so simple in construction that the cost of manufacturing it permits it to be considered disposable after a single use, or, depending on the material out of which it is made, can be reusable and kept by the customer as a favor.

In a preferred embodiment of this invention the taco holder comprises an extended flat member having a pair of side walls coextensive with the length of said flat member and slots formed in each of the side walls to permit exposure of the taco shell to grasping by fingers down to the last mouthful of the taco while at the same time maintaining upright support of the shell.

Other embodiments of the invention include other features which render the holder useful for its intended purpose.

It is thus a principal object of this invention to provide a taco holder of improved efficiency and construction.

Other objects and advantages of this invention will become obvious from the following description of preferred embodiments of this invention.

DESCRIPTION OF THE PREFERRED EMBODIMENTS

Figure 1:
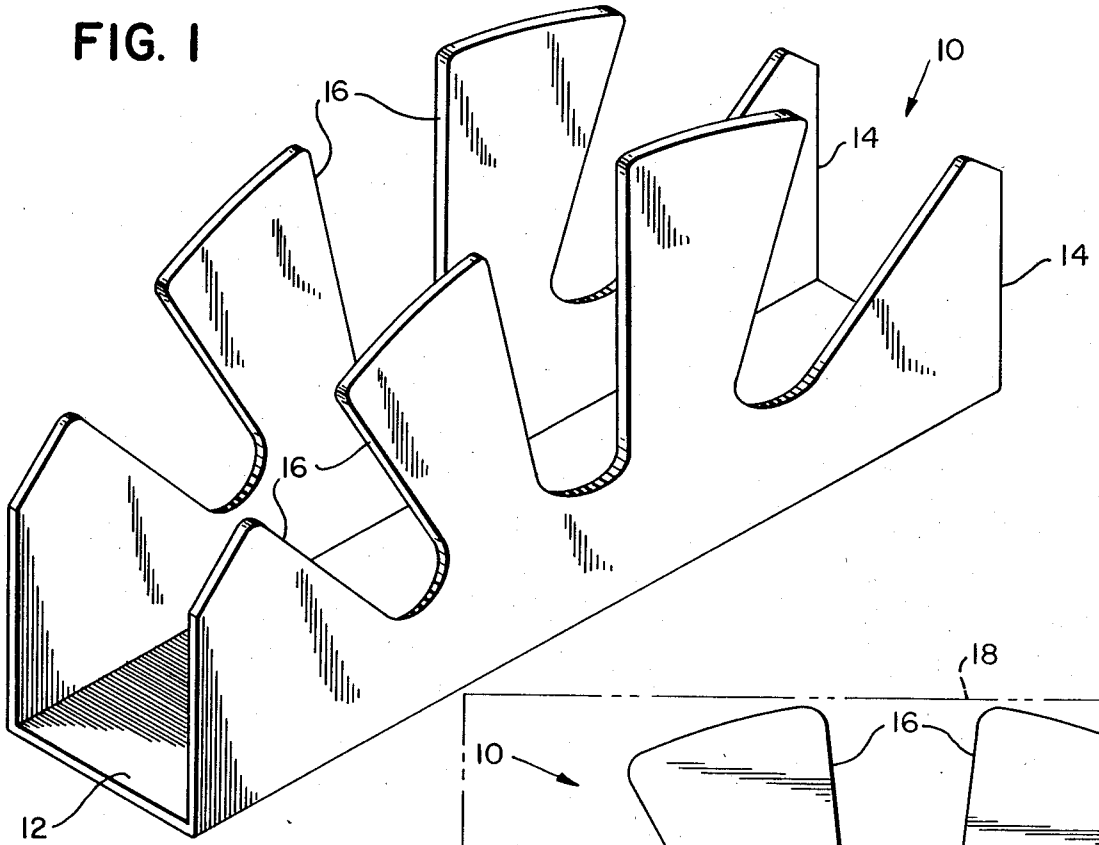
FIG. 1 is an isometric view of a preferred embodiment of this invention.
Figure 3:
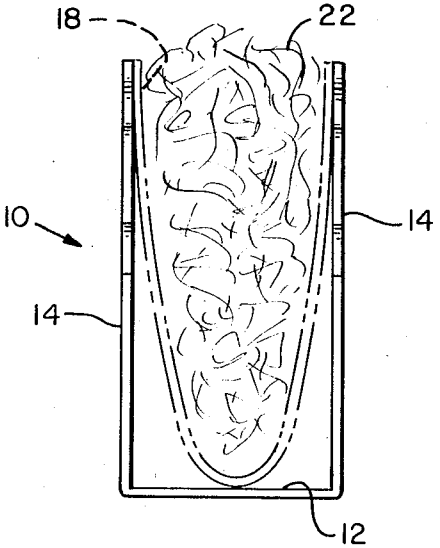
FIG. 3 is a right side view of the holder shown in FIG. 2.
Figure 2:
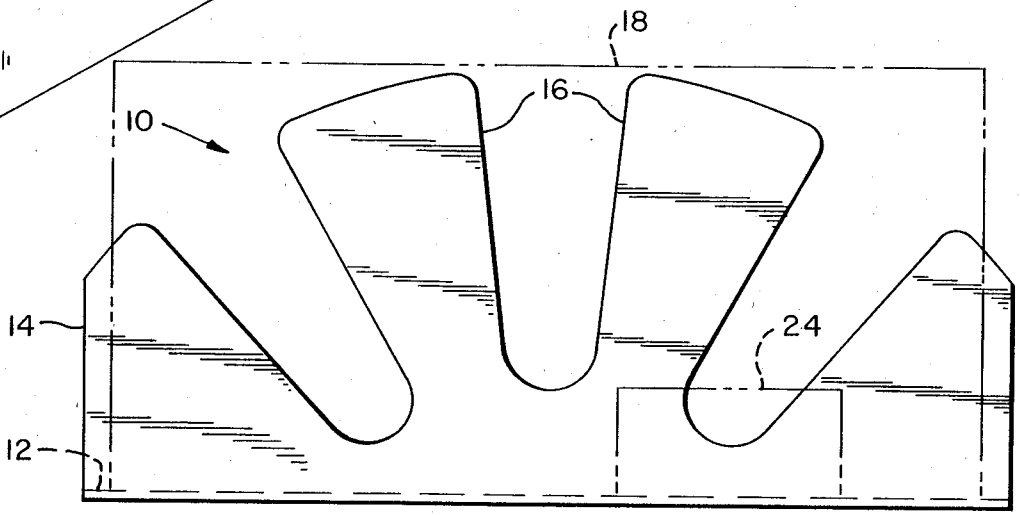
FIG. 2 is a front elevation view of the embodiment shown in FIG. 1.

Referring to FIGS. 1, 2, and 3 it will be seen that taco holder 10 consists of an extended flat portion 12 having a pair of side walls 14 coextensive with the length of the former. The upper edges of side walls 14 are curved as illustrated and are provided with radially extending slots 16. Slots 16 are of sufficient width to accommodate fingers.

Shown in phantom in FIGS. 2 and 3 is a V-shaped taco shell 18 filled with finely cut pieces 22 of food prior to being eaten. It will be seen that slots 16 make it very convenient to grasp taco 18. As the latter becomes eaten away and diminishes in size, as shown by the small piece 24 also shown in phantom, the partially eaten taco can be placed in holder 10 in a location where it can conveniently be grasped while at the same time the taco is held in an upright position where all of the food can be retained in the shell.

Holder 10 would ordinarily be made out of a single piece of material such as a plastic. For disposable application, a holder 10 can be made out of a flat piece of foldable material such as cardboard 26 shown in FIG. 4 with fold lines 28 and 32.

Figure 6:
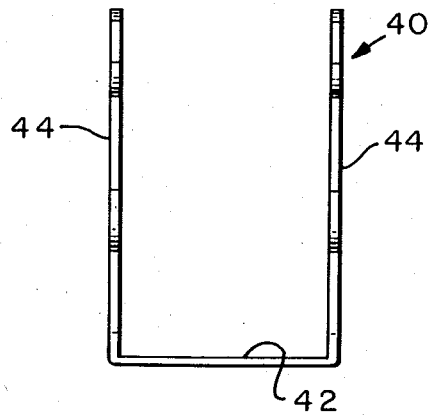
FIGS. 5 and 6 are front and end elevation views of another embodiment of this invention.
Figure 5:
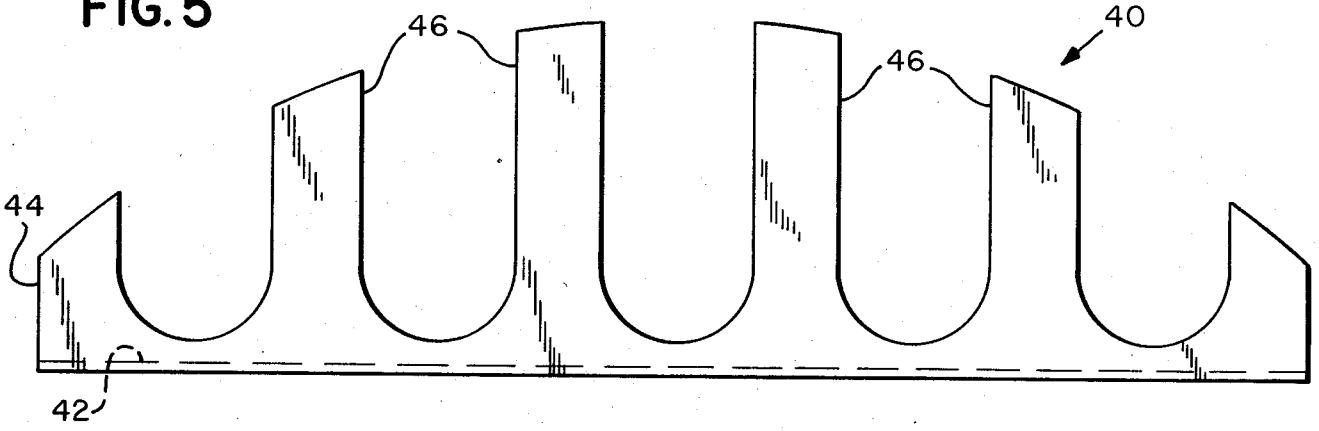

Instead of having slots 16 radially extending as illustrated in FIGS. 1 and 2, it may be desirable to have the slots of even width and vertically arranged. This configuration is illustrated in FIGS. 5 and 6 where taco holder 40 is shown with a flat bottom portion 42 and side walls 44 with vertically extending slots 46 of even width.

In another variation of this invention, the slots can be eliminated and yet at the same time provide for the support of the V-shaped taco down to the last edible mouthful.

Figure 8:
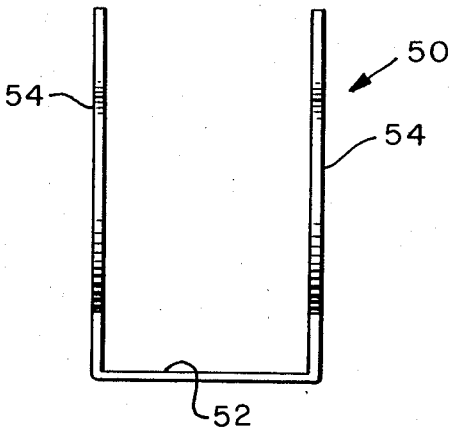
FIGS 7 and 8 are front and end elevation views of still another embodiment of this invention.
Figure 7:
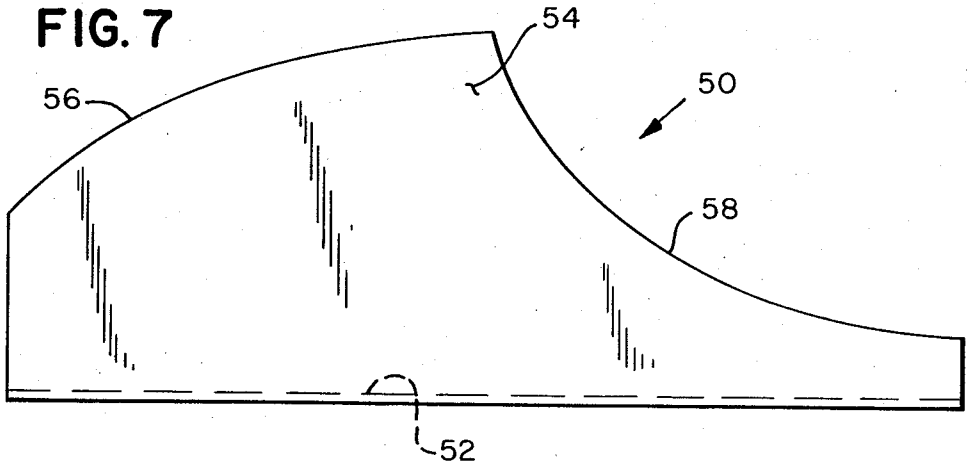

Such an arrangement is shown in FIGS. 7 and 8 where holder 50 consists of a flat bottom portion 52 and side walls 54. In this embodiment, each of side walls 54 is provided with a pair of curved edges, the upper convex portion 56 and the lower concave portion 58. In this construction it is seen that the taco with full or almost full depth can be placed opposite the upper curved portion 56 whereas when the taco is down to a relatively small size, especially in depth, it will be placed opposite lower curved portion 58 of side walls 54. This construction is less expensive than the slotted designs and so under some circumstances would be more suitable for disposable application.

Figure 4:
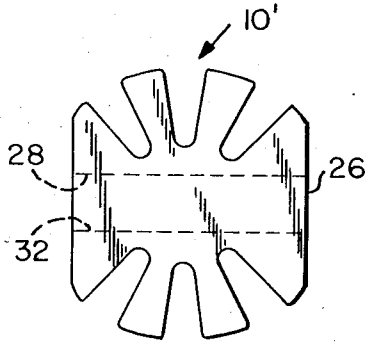
FIG. 4 is a plan view of the taco holder of FIGS. 1, 2, and 3 made of foldable material prior to folding.

All of the embodiments herein described would be made of inexpensive material such as plastic or cardboard, and all may be made foldable as in the arrangement shown in FIG. 4.

It is thus seen that there has been provided a unique taco holder which is highly effective in supporting a V-shaped taco upright during the course of being eaten while at the same time making it convenient and sanitary to reach in and pick up the partially eaten taco.

While only certain embodiments of this invention have been described it is understood that many variations are possible without departing from the principles of this invention as defined in the claims which follow.

What is claimed is:

1. A taco holder made from a single flat sheet of material folded along previously prepared fold lines comprising an extended flat portion having a pair of side walls coextensive with the length of said flat portion and means formed in each of said side walls to permit exposure of said taco to grasping by the fingers of the eater of said taco down to the last mouthful thereof while at the same time maintaining upright support of said taco, said formed means consisting of radially extending slots of varying width and depth to accommodate fingers extending from the upper edges of said walls to points close enough to said flat member to support a single mouthful of said taco.

2. The taco holder of claim 1 in which said side walls are at substantially right angles to the surface of said flat portion.

3. The taco holder of claim 2 in which the upper edges of said walls are convex.

4. A taco holder made from a single sheet of material folded along previously prepared fold lines comprising an extended flat portion having a pair of side walls coextensive with the length of said flat portion and means formed in each of said side walls to permit exposure of said taco to grasping by the fingers of the eater of said taco down to the last mouthful thereof while at the same time maintaining upright support of said taco, said formed means consisting of said side walls having both convex and concave shaped portions of upper edges to permit a partially eaten taco to be placed at a location where the shell of the taco is exposed to grasping by the fingers down to the last mouthful of said taco.

* * * * *